US007281587B2

(12) United States Patent
Haugen

(10) Patent No.: US 7,281,587 B2
(45) Date of Patent: Oct. 16, 2007

(54) APPARATUS AND METHODS FOR TUBULAR MAKEUP INTERLOCK

(75) Inventor: David M. Haugen, League City, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 11/393,311

(22) Filed: Mar. 30, 2006

(65) Prior Publication Data

US 2006/0169461 A1 Aug. 3, 2006

Related U.S. Application Data

(63) Continuation of application No. 10/625,840, filed on Jul. 23, 2003, now Pat. No. 7,073,598, which is a continuation of application No. 09/860,127, filed on May 17, 2001, now Pat. No. 6,742,596.

(51) Int. Cl.
*E21B 19/16* (2006.01)

(52) U.S. Cl. ..... 166/380; 166/77.52; 166/77.53; 166/85.1

(58) Field of Classification Search ..... None
See application file for complete search history.

(56) References Cited

U.S. PATENT DOCUMENTS

| | | | |
|---|---|---|---|
| 179,973 | A | 7/1876 | Thornton |
| 1,418,766 | A | 6/1922 | Wilson |
| 1,585,069 | A | 5/1926 | Youle |
| 1,728,136 | A | 9/1929 | Power |
| 1,777,592 | A | 10/1930 | Thomas |
| 1,805,007 | A | 5/1931 | Pedley |
| 1,825,026 | A | 9/1931 | Thomas |
| 1,842,638 | A | 1/1932 | Wigle |
| 1,917,135 | A | 7/1933 | Littell |
| 2,105,885 | A | 1/1938 | Hinderliter |
| 2,128,430 | A | 8/1938 | Pryor |
| 2,167,338 | A | 7/1939 | Murcell |
| 2,184,681 | A | 12/1939 | Osmun et al. |
| 2,214,429 | A | 9/1940 | Miller |
| 2,414,719 | A | 1/1947 | Cloud |
| 2,522,444 | A | 9/1950 | Grable |
| 2,536,458 | A | 1/1951 | Munsinger |
| 2,570,080 | A | 10/1951 | Stone |
| 2,610,690 | A | 9/1952 | Beatty |

(Continued)

FOREIGN PATENT DOCUMENTS

| | | |
|---|---|---|
| CA | 2 307 386 | 11/2000 |

(Continued)

OTHER PUBLICATIONS

Dennis L. Bickford and Mark J. Mabile, Casing Drilling Rig Selection For Stratton Field, Texas, World Oil, vol. 226 No., Mar. 2005.

(Continued)

*Primary Examiner*—Zakiya W. Bates
(74) *Attorney, Agent, or Firm*—Patterson & Sheridan, LLP

(57) ABSTRACT

Apparatus and methods used to prevent an operator from inadvertently dropping a string into a wellbore during assembling and disassembling of tubulars. Additionally, the apparatus and methods may be used for running in wellbore components or for a drill string.

81 Claims, 10 Drawing Sheets

U.S. PATENT DOCUMENTS

| | | | |
|---|---|---|---|
| 2,641,444 | A | 6/1953 | Moon |
| 2,668,689 | A | 2/1954 | Cormany |
| 2,692,059 | A | 10/1954 | Bolling, Jr. |
| 2,953,406 | A | 9/1960 | Young |
| 2,965,177 | A | 12/1960 | Bus, Sr. et al. |
| 3,041,901 | A | 7/1962 | Knights |
| 3,087,546 | A | 4/1963 | Wooley |
| 3,122,811 | A | 3/1964 | Gilreath |
| 3,193,116 | A | 7/1965 | Kenneday et al. |
| 3,266,582 | A | 8/1966 | Homanick |
| 3,380,528 | A | 4/1968 | Timmons |
| 3,392,609 | A | 7/1968 | Bartos |
| 3,477,527 | A | 11/1969 | Koot |
| 3,489,220 | A | 1/1970 | Kinley |
| 3,518,903 | A | 7/1970 | Ham et al. |
| 3,548,936 | A | 12/1970 | Kilgore et al. |
| 3,552,507 | A | 1/1971 | Brown |
| 3,552,508 | A | 1/1971 | Brown |
| 3,552,509 | A | 1/1971 | Brown |
| 3,552,510 | A | 1/1971 | Brown |
| 3,566,505 | A | 3/1971 | Martin |
| 3,570,598 | A | 3/1971 | Johnson |
| 3,602,302 | A | 8/1971 | Kluth |
| 3,606,664 | A | 9/1971 | Weiner |
| 3,635,105 | A | 1/1972 | Dickmann, et al. |
| 3,638,989 | A | 2/1972 | Sandquist |
| 3,662,842 | A | 5/1972 | Bromell |
| 3,680,412 | A | 8/1972 | Mayer et al. |
| 3,691,825 | A | 9/1972 | Dyer |
| 3,700,048 | A | 10/1972 | Desmoulins |
| 3,706,347 | A | 12/1972 | Brown |
| 3,746,330 | A | 7/1973 | Taciuk |
| 3,747,875 | A | 7/1973 | Brown |
| 3,766,991 | A | 10/1973 | Brown |
| 3,776,320 | A | 12/1973 | Brown |
| 3,780,883 | A | 12/1973 | Brown |
| 3,808,916 | A | 5/1974 | Porter et al. |
| 3,838,613 | A | 10/1974 | Wilms |
| 3,840,128 | A | 10/1974 | Swoboda, Jr. et al. |
| 3,848,684 | A | 11/1974 | West |
| 3,857,450 | A | 12/1974 | Guier |
| 3,871,618 | A | 3/1975 | Funk |
| 3,881,375 | A | 5/1975 | Kelly |
| 3,885,679 | A | 5/1975 | Swoboda, Jr. et al. |
| 3,901,331 | A | 8/1975 | Djurovic |
| 3,913,687 | A | 10/1975 | Gyongyosi et al. |
| 3,915,244 | A | 10/1975 | Brown |
| 3,964,552 | A | 6/1976 | Slator |
| 3,980,143 | A | 9/1976 | Swartz et al. |
| 4,054,332 | A | 10/1977 | Bryan, Jr. |
| 4,077,525 | A | 3/1978 | Callegari et al. |
| 4,091,451 | A | 5/1978 | Weiner et al. |
| 4,100,968 | A | 7/1978 | Delano |
| 4,127,927 | A | 12/1978 | Hauk et al. |
| 4,142,739 | A | 3/1979 | Billingsley |
| 4,202,225 | A | 5/1980 | Sheldon et al. |
| 4,221,269 | A | 9/1980 | Hudson |
| 4,257,442 | A | 3/1981 | Claycomb |
| 4,262,693 | A | 4/1981 | Giebeler |
| 4,274,777 | A | 6/1981 | Scaggs |
| 4,274,778 | A | 6/1981 | Putnam et al. |
| 4,280,380 | A | 7/1981 | Eshghy |
| 4,315,553 | A | 2/1982 | Stallings |
| 4,320,915 | A | 3/1982 | Abbott et al. |
| 4,365,402 | A | 12/1982 | McCombs et al. |
| 4,437,363 | A | 3/1984 | Haynes |
| 4,440,220 | A | 4/1984 | McArthur |
| 4,446,745 | A | 5/1984 | Stone et al. |
| 4,449,596 | A | 5/1984 | Boyadjieff |
| 4,472,002 | A | 9/1984 | Beney et al. |
| 4,489,794 | A | 12/1984 | Boyadjieff |
| 4,492,134 | A | 1/1985 | Reinhldt et al. |
| 4,494,424 | A | 1/1985 | Bates |
| 4,515,045 | A | 5/1985 | Gnatchenko et al. |
| 4,529,045 | A | 7/1985 | Boyadjieff et al. |
| 4,570,706 | A | 2/1986 | Pugnet |
| 4,592,125 | A | 6/1986 | Skene |
| 4,593,584 | A | 6/1986 | Neves |
| 4,593,773 | A | 6/1986 | Skeie |
| 4,604,724 | A | 8/1986 | Shaginian et al. |
| 4,604,818 | A | 8/1986 | Inoue |
| 4,605,077 | A | 8/1986 | Boyadjieff |
| 4,613,161 | A | 9/1986 | Brisco |
| 4,625,796 | A | 12/1986 | Boyadjieff |
| 4,646,827 | A | 3/1987 | Cobb |
| 4,649,777 | A | 3/1987 | Buck |
| 4,652,195 | A | 3/1987 | McArthur |
| 4,667,752 | A | 5/1987 | Berry et al. |
| 4,676,312 | A | 6/1987 | Mosing et al. |
| 4,681,158 | A | 7/1987 | Pennison |
| 4,681,162 | A | 7/1987 | Boyd |
| 4,683,962 | A | 8/1987 | True |
| 4,686,873 | A | 8/1987 | Lang et al. |
| 4,709,599 | A | 12/1987 | Buck |
| 4,709,766 | A | 12/1987 | Boyadjieff |
| 4,725,179 | A | 2/1988 | Woolslayer et al. |
| 4,735,270 | A | 4/1988 | Fenyvesi |
| 4,736,145 | A | 4/1988 | Vincent et al. |
| 4,742,876 | A | 5/1988 | Barthelemy et al. |
| 4,759,239 | A | 7/1988 | Hamilton et al. |
| 4,762,187 | A | 8/1988 | Haney |
| 4,765,401 | A | 8/1988 | Boyadjieff |
| 4,765,416 | A | 8/1988 | Bjerking et al. |
| 4,773,689 | A | 9/1988 | Wolters |
| 4,781,359 | A | 11/1988 | Matus |
| 4,791,997 | A | 12/1988 | Krasnov |
| 4,793,422 | A | 12/1988 | Krasnov |
| 4,800,968 | A | 1/1989 | Shaw et al. |
| 4,813,493 | A | 3/1989 | Shaw et al. |
| 4,813,495 | A | 3/1989 | Leach |
| 4,821,814 | A | 4/1989 | Willis et al. |
| 4,832,552 | A | 5/1989 | Skelly |
| 4,836,064 | A | 6/1989 | Slator |
| 4,843,945 | A | 7/1989 | Dinsdale |
| 4,867,236 | A | 9/1989 | Haney et al. |
| 4,878,546 | A | 11/1989 | Shaw et al. |
| 4,899,816 | A | 2/1990 | Mine |
| 4,909,741 | A | 3/1990 | Schasteen et al. |
| 4,921,386 | A | 5/1990 | McArthur |
| 4,936,382 | A | 6/1990 | Thomas |
| 4,962,579 | A | 10/1990 | Moyer et al. |
| 4,962,819 | A | 10/1990 | Bailey et al. |
| 4,971,146 | A | 11/1990 | Terrell |
| 4,997,042 | A | 3/1991 | Jordan et al. |
| 5,022,472 | A | 6/1991 | Bailey et al. |
| 5,036,927 | A | 8/1991 | Willis |
| 5,049,020 | A | 9/1991 | McArthur |
| 5,060,542 | A | 10/1991 | Hauk |
| 5,062,756 | A | 11/1991 | McArthur et al. |
| 5,107,940 | A | 4/1992 | Berry |
| 5,111,893 | A | 5/1992 | Kvello-Aune |
| RE34,063 | E | 9/1992 | Vincent et al. |
| 5,191,939 | A | 3/1993 | Stokley |
| 5,233,742 | A | 8/1993 | Gray et al. |
| 5,245,265 | A | 9/1993 | Clay |
| 5,251,709 | A | 10/1993 | Richardson |
| 5,255,751 | A | 10/1993 | Stogner |
| 5,272,925 | A | 12/1993 | Henneuse et al. |
| 5,282,653 | A | 2/1994 | LaFleur et al. |
| 5,284,210 | A | 2/1994 | Helms et al. |
| 5,294,228 | A | 3/1994 | Willis et al. |
| 5,297,833 | A | 3/1994 | Willis et al. |
| 5,305,839 | A | 4/1994 | Kalsi et al. |
| 5,332,043 | A | 7/1994 | Ferguson |

5,340,182 A 8/1994 Businck et al.
5,351,767 A 10/1994 Stogner et al.
5,354,150 A 10/1994 Canales
5,368,113 A 11/1994 Schulze-Beckinghausen
5,386,746 A 2/1995 Hauk
5,388,651 A 2/1995 Berry
5,433,279 A 7/1995 Tassari et al.
5,461,905 A 10/1995 Penisson
5,497,840 A 3/1996 Hudson
5,501,280 A 3/1996 Brisco
5,501,286 A 3/1996 Berry
5,503,234 A 4/1996 Clanton
5,535,824 A 7/1996 Hudson
5,575,344 A 11/1996 Wireman
5,577,566 A 11/1996 Albright et al.
5,584,343 A 12/1996 Coone
5,588,916 A 12/1996 Moore
5,645,131 A 7/1997 Trevisani
5,661,888 A 9/1997 Hanslik
5,667,026 A 9/1997 Lorenz et al.
5,706,894 A 1/1998 Hawkins, III
5,711,382 A 1/1998 Hansen et al.
5,735,348 A 4/1998 Hawkins, III
5,735,351 A 4/1998 Helms
5,746,276 A 5/1998 Stuart
5,765,638 A 6/1998 Taylor
5,772,514 A 6/1998 Moore
5,785,132 A 7/1998 Richardson et al.
5,791,410 A 8/1998 Castille et al.
5,803,191 A 9/1998 Mackintosh
5,833,002 A 11/1998 Holcombe
5,836,395 A 11/1998 Budde
5,839,330 A 11/1998 Stokka
5,842,530 A 12/1998 Smith et al.
5,850,877 A 12/1998 Albright et al.
5,890,549 A 4/1999 Sprehe
5,909,768 A 6/1999 Castille et al.
5,931,231 A 8/1999 Mock
5,960,881 A 10/1999 Allamon et al.
5,971,079 A 10/1999 Mullins
5,971,086 A 10/1999 Bee et al.
6,000,472 A 12/1999 Albright et al.
6,012,529 A 1/2000 Mikolajczyk et al.
6,056,060 A 5/2000 Abrahamsen et al.
6,065,550 A 5/2000 Gardes
6,070,500 A 6/2000 Dlask et al.
6,079,509 A 6/2000 Bee et al.
6,119,772 A 9/2000 Pruet
6,142,545 A 11/2000 Penman et al.
6,161,617 A 12/2000 Gjedebo
6,170,573 B1 1/2001 Brunet et al.
6,173,777 B1 1/2001 Mullins
6,199,641 B1 3/2001 Downie et al.
6,202,764 B1 3/2001 Ables et al.
6,217,258 B1 4/2001 Yamamoto et al.
6,227,587 B1 5/2001 Terral
6,237,684 B1 5/2001 Bouligny, Jr. et al.
6,276,450 B1 8/2001 Seneviratne
6,279,654 B1 8/2001 Mosing et al.
6,309,002 B1 10/2001 Bouligny
6,311,792 B1 11/2001 Scott et al.
6,315,051 B1 11/2001 Ayling
6,334,376 B1 1/2002 Torres
6,349,764 B1 2/2002 Adams et al.
6,360,633 B2 3/2002 Pietras
6,378,630 B1 4/2002 Ritorto et al.
6,390,190 B2 5/2002 Mullins
6,412,554 B1 7/2002 Allen et al.
6,431,626 B1 8/2002 Bouligny
6,443,241 B1 * 9/2002 Juhasz et al. ..... 175/52
6,527,047 B1 3/2003 Pietras
6,527,493 B1 3/2003 Kamphorst et al.
6,536,520 B1 3/2003 Snider et al.
6,553,825 B1 4/2003 Boyd
6,591,471 B1 7/2003 Hollingsworth et al.
6,595,288 B2 7/2003 Mosing et al.
6,622,796 B1 9/2003 Pietras
6,637,526 B2 10/2003 Juhasz et al.
6,651,737 B2 11/2003 Bouligny
6,668,684 B2 12/2003 Allen et al.
6,679,333 B2 1/2004 York et al.
6,688,394 B1 2/2004 Ayling
6,688,398 B2 2/2004 Pietras
6,691,801 B2 2/2004 Juhasz et al.
6,725,938 B1 4/2004 Pietras
6,732,822 B2 5/2004 Slack et al.
6,742,584 B1 6/2004 Appleton
6,742,596 B2 6/2004 Haugen
6,832,656 B2 12/2004 Cameron
6,832,658 B2 12/2004 Keast
6,840,322 B2 1/2005 Haynes
6,892,835 B2 5/2005 Shahin et al.
6,907,934 B2 6/2005 Kauffman et al.
7,096,977 B2 8/2006 Juhasz et al.
7,100,698 B2 9/2006 Kracik et al.
2001/0042625 A1 11/2001 Appleton
2002/0029878 A1 3/2002 Victor
2002/0108748 A1 8/2002 Keyes
2002/0170720 A1 11/2002 Haugen
2003/0155159 A1 8/2003 Slack et al.
2003/0164276 A1 9/2003 Snider et al.
2003/0173073 A1 9/2003 Snider et al.
2003/0221519 A1 12/2003 Haugen et al.
2004/0003490 A1 1/2004 Shahin et al.
2004/0069500 A1 4/2004 Haugen
2004/0144547 A1 7/2004 Koithan et al.
2004/0173358 A1 9/2004 Haugen
2004/0216924 A1 11/2004 Pietras et al.
2004/0251050 A1 12/2004 Shahin et al.
2004/0251055 A1 12/2004 Shahin et al.
2005/0000691 A1 1/2005 Giroux et al.
2005/0051343 A1 3/2005 Pietras et al.
2005/0096846 A1 5/2005 Koithan et al.
2005/0098352 A1 5/2005 Beierbach et al.

FOREIGN PATENT DOCUMENTS

DE 3 523 221 2/1987
EP 0 087 373 8/1983
EP 0 162 000 11/1985
EP 0 171 144 2/1986
EP 0 285 386 10/1988
EP 0 474 481 3/1992
EP 0 479 583 4/1992
EP 0 525 247 2/1993
EP 0 589 823 3/1994
EP 1148206 10/2001
EP 1 256 691 11/2002
GB 1 469 661 4/1977
GB 2 053 088 2/1981
GB 2 201 912 9/1988
GB 2 223 253 4/1990
GB 2 224 481 9/1990
GB 2 240 799 8/1991
GB 2 275 486 4/1993
GB 2 345 074 6/2000
GB 2 357 530 6/2001
JP 2001-173349 6/2001
WO WO90-06418 6/1990
WO WO92-18743 10/1992
WO WO93-07358 4/1993
WO WO95-10686 4/1995
WO WO96-18799 6/1996
WO WO97-08418 3/1997
WO WO98-05844 2/1998
WO WO98-11322 3/1998

| | | |
|---|---|---|
| WO | WO98-32948 | 7/1998 |
| WO | WO99-11902 | 3/1999 |
| WO | WO99-41485 | 8/1999 |
| WO | WO99-58810 | 11/1999 |
| WO | WO 00-08293 | 2/2000 |
| WO | WO 00-09853 | 2/2000 |
| WO | WO 00-11309 | 3/2000 |
| WO | WO 00-11310 | 3/2000 |
| WO | WO 00-11311 | 3/2000 |
| WO | WO 00-39429 | 7/2000 |
| WO | WO 00-39430 | 7/2000 |
| WO | WO 00-50730 | 8/2000 |
| WO | WO 01-12946 | 2/2001 |
| WO | WO 01/33033 | 5/2001 |
| WO | WO 01-94738 | 12/2001 |
| WO | WO 04-022903 | 3/2004 |

OTHER PUBLICATIONS

"First Success with Casing-Drilling" Word Oil, Feb. (1999), pp. 25.

Laurent, et al., "A New Generation Drilling Rig: Hydraulically Powered And Computer Controlled," CADE/CAODC Paper 99-120, CADE/CAODC Spring Drilling Conference, Apr. 7 & 8, 1999, 14 pages.

Laurent, et al., "Hydraulic Rig Supports Casing Drilling," World Oil, Sep. 1999, pp. 61-68.

Shepard, et al., "Casing Drilling: An Emerging Technology," IADC/SPE Paper 67731, SPE/IADC Drilling Conference, Feb. 27-Mar. 1, 2001, pp. 1-13.

Warren, et al., "Casing Drilling Technology Moves To More Challenging Application," AADE Paper 01-NC-HO-32, AADE National Drilling Conferecne, Mar. 27-29, 2001, pp. 1-10.

Fontenot, et al., "New Rig Design Enhances Casing Drilling Operations In Lobo Trend," paper WOCD-0306-04, World Oil Casing Drilling Technical Conference, Mar. 6-7, 2003, pp. 1-13.

Vincent, et al., "Liner And Casing Drilling—Case Histories And Technology," Paper WOCD-0307-02, World Oil Casing Drilling Technical Conference, Mar. 6-7, 2003, pp. 1-20.

Tessari, et al., "Retrievable Tools Provide Flexibility for Casing Drilling," Paper No. WOCD-0306-01, World Oil Casing Drilling Technical Conference, 2003, pp. 1-11.

Tommy Warren, SPE, Bruce Houtchens, SPE, Garret Madell, SPE, Directional Drilling With Casing, SPE/IADC 79914, Tesco Corporation, SPE/IADC Drilling Conference 2003.

LaFleur Petroleum Services, Inc., "Autoseal Circulating Head," Engineering Manufacturing, 1992, 11 Pages.

Canrig Top Drive Drilling Systems, Harts Petroleum Engineer International, Feb. 1997, 2 Pages.

The Original Portable Top Drive Drilling System, TESCO Drilling Technology, 1997.

Mike Killalea, Portable Top Drives: What's Driving The Marked?, IADC, Drilling Contractor, Sep. 1994, 4 Pages.

500 or 650 ECIS Top Drive, Advanced Permanent Magnet Motor Technology, TESCO Drilling Technology, Apr. 1998, 2 Pages.

500 or 650 HCIS Top Drive, Powerful Hydraulic Compact Top Drive Drilling System, TESCO Drilling Technology, Apr. 1998, 2 Pages.

Product Information (Sections 1-10) CANRIG Drilling Technology, Ltd., Sep. 18, 1996.

Coiled Tubing Handbook, World Oil, Gulf Publishing Company, 1993.

G H. Kamphorst, G. L. Van Wechem, W. Boom, D. Bottger, and K. Koch, Casing Running Tool, SPE/IADC 52770.

EP Search Report, Application No. 06126558.3 - 2315, dated May 8, 2007.

* cited by examiner

APPARATUS AND METHODS FOR TUBULAR MAKEUP INTERLOCK

CROSS-REFERENCE TO RELATED APPLICATIONS

This application is a continuation of U.S. patent application Ser. No. 10/625,840, filed Jul. 23, 2003 now U.S. Pat. No. 7,037,598, which is a continuation of U.S. patent application Ser. No. 09/860,127, filed May 17, 2001, now U.S. Pat. No. 6,742,596, which applications are herein incorporated by reference in their entirety.

BACKGROUND OF THE INVENTION

1. Field of the Invention

The present invention relates to an apparatus and methods for facilitating the connection of tubulars. More particularly, the invention relates to an interlock system for a top drive and a spider for use in assembling or disassembling tubulars.

2. Background of the Related Art

In the construction and completion of oil or gas wells, a drilling rig is constructed on the earth's surface to facilitate the insertion and removal of tubular strings into a wellbore. The drilling rig includes a platform and power tools such as an elevator and a spider to engage, assemble, and lower the tubulars into the wellbore. The elevator is suspended above the platform by a draw works that can raise or lower the elevator in relation to the floor of the rig. The spider is mounted in the platform floor. The elevator and spider both have slips that are capable of engaging and releasing a tubular, and are designed to work in tandem. Generally, the spider holds a tubular or tubular string that extends into the wellbore from the platform. The elevator engages a new tubular and aligns it over the tubular being held by the spider. A power tong and a spinner are then used to thread the upper and lower tubulars together. Once the tubulars are joined, the spider disengages the tubular string and the elevator lowers the tubular string through the spider until the elevator and spider are at a predetermined distance from each other. The spider then re-engages the tubular string and the elevator disengages the string and repeats the process. This sequence applies to assembling tubulars for the purpose of drilling a wellbore, running casing to line the wellbore, or running wellbore components into the well. The sequence can be reversed to disassemble the tubular string.

During the drilling of a wellbore, a drill string is made up and is then necessarily rotated in order to drill. Historically, a drilling platform includes a rotary table and a gear to turn the table. In operation, the drill string is lowered by an elevator into the rotary table and held in place by a spider. A Kelly is then threaded to the string and the rotary table is rotated, causing the Kelly and the drill string to rotate. After thirty feet or so of drilling, the Kelly and a section of the string are lifted out of the wellbore, and additional drill string is added.

The process of drilling with a Kelly is expensive due to the amount of time required to remove the Kelly, add drill string, reengage the Kelly, and rotate the drill string. In order to address these problems, top drives were developed.

For example, International Application Number PCT/GB99/02203, published on Feb. 3, 2000 discloses apparatus and methods for connecting tubulars using a top drive. In another example, FIG. 1 shows a drilling rig 100 configured to connect and run casings into a newly formed wellbore 180 to line the walls thereof. As shown, the rig 100 includes a top drive 200, an elevator 120, and a spider 400. The rig 100 is built at the surface 170 of the well. The rig 100 includes a traveling block 110 that is suspended by wires 150 from draw works 105 and holds the top drive 200. The top drive 200 has a gripping means 301 for engaging the inner wall of the casing 15 and a motor 240 to rotate the casing 15. The motor 240 may rotate and thread the casing 15 into the casing string 16 held by the spider 400. The gripping means 301 facilitate the engagement and disengagement of the casing 15 without having to thread and unthread the casing 15 to the top drive 200. Additionally, the top drive 200 is coupled to a railing system 140. The railing system 140 prevents the top drive 200 from rotational movement during rotation of the casing string 16, but allows for vertical movement of the top drive 200 under the traveling block 110.

In FIG. 1, the top drive 200 is shown engaged to casing 15. The casing 15 is placed in position below the top drive 200 by the elevator 120 in order for the top drive 200 to engage the casing 15. Additionally, the spider 400, disposed on the platform 160, is shown engaged around a casing string 16 that extends into wellbore 180. Once the casing 15 is positioned above the casing string 16, the top drive 200 can lower and thread the casing 15 into the casing string 16, thereby extending the length of the casing string 16. Thereafter, the extended casing string 16 may be lowered into the wellbore 180.

FIG. 2 illustrates the top drive 200 engaged to the casing string 16 after the casing string 16 has been lowered through a spider 400. The spider 400 is shown disposed on the platform 160. The spider 400 comprises a slip assembly 440 including a set of slips 410 and piston 420. The slips 410 are wedge-shaped and constructed and arranged to slidably move along a sloped inner wall of the slip assembly 440. The slips 410 are raised or lowered by the piston 420. When the slips 410 are in the lowered position, they close around the outer surface of the casing string 16. The weight of the casing string 16 and the resulting friction between the casing string 16 and the slips 410 force the slips downward and inward, thereby tightening the grip on the casing string 16. When the slips 410 are in the raised position as shown, the slips 410 are opened and the casing string 16 is free to move axially in relation to the slips 410.

FIG. 3 is cross-sectional view of a top drive 200 and a casing 15. The top drive 200 includes a gripping means 301 having a cylindrical body 300, a wedge lock assembly 350, and slips 340 with teeth (not shown). The wedge lock assembly 350 and the slips 340 are disposed around the outer surface of the cylindrical body 300. The slips 340 are constructed and arranged to mechanically grip the inside of the casing 15. The slips 340 are threaded to piston 370 located in a hydraulic cylinder 310. The piston 370 is actuated by pressurized hydraulic fluid injected through fluid ports 320, 330. Additionally, springs 360 are located in the hydraulic cylinder 310 and are shown in a compressed state. When the piston 370 is actuated, the springs 360 decompress and assist the piston 370 in moving the slips 340 relative to the cylindrical body 300. The wedge lock assembly 350 is connected to the cylindrical body 300 and constructed and arranged to force the slips 340 against the inner wall of the casing 15.

In operation, the slips 340, and the wedge lock assembly 350 of top drive 200 are lowered inside the casing 15. Once the slips 340 are in the desired position within the casing 15, pressurized fluid is injected into the piston 370 through fluid port 320. The fluid actuates the piston 370, which forces the slips 340 towards the wedge lock assembly 350. The wedge lock assembly 350 functions to bias the slips 340 outwardly as the slips 340 are slidably forced along the outer surface of the assembly 350, thereby forcing the slips 340 to engage the inner wall of the casing 15.

FIG. 4 illustrates a cross-sectional view of a top drive 200 engaged to the casing 15. Particularly, the figure shows the slips 340 engaged with the inner wall of the casing 15 and a spring 360 in the decompressed state. In the event of a hydraulic fluid failure, the springs 360 can bias the piston 370 to keep the slips 340 in the engaged position, thereby providing an additional safety feature to prevent inadvertent release of the casing string 16. Once the slips 340 are engaged with the casing 15, the top drive 200 can be raised along with the cylindrical body 300. By raising the body 300, the wedge lock assembly 350 will further bias the slips 340 outward. With the casing 15 retained by the top drive 200, the top drive 200 may relocate the casing 15 to align and thread the casing 15 with casing string 16.

In another embodiment (not shown), a top drive includes a gripping means for engaging a casing on the outer surface. For example, the slips of the gripping means can be arranged to grip on the outer surface of the casing, preferably gripping under the collar of the casing. In operation, the top drive is positioned over the desired casing. The slips are then lowered by the top drive to engage the collar of the casing. Once the slips are positioned beneath the collar, the piston is actuated to cause the slips to grip the outer surface of the casing.

FIG. 5 is a flow chart illustrating a typical operation of running casing using a top drive 200 and a spider 400. The flow chart relates to the operation of an apparatus generally illustrated in FIG. 1. At a first step 500, a casing string 16 is retained in a closed spider 400 and is thereby prevented from moving in an axial direction. At step 510, top drive 200 is moved to engage a casing 15 with the aid of an elevator 120. Engagement of the casing 15 by the top drive 200 includes grasping the casing 15 and engaging the inner surface thereof. At step 520, the top drive 200 moves the casing 15 into position above the casing string 16 for connection therewith. At step 530, the top drive 200 threads the casing 15 to casing string 16. At step 540, the spider 400 is opened and disengages the casing string 16. At step 550, the top drive 200 lowers the extended casing string 16 through the opened spider 400. At step 560, the spider 400 is closed around the casing string 16. At step 570, the top drive 200 disengages the casing string 16 and can proceed to add another casing 15 to the casing string 16 as in step 510. The above-described steps may be utilized to run drill string in a drilling operation, to run casing to reinforce the wellbore, or to assemble run-in strings to place wellbore components in the wellbore. The steps may also be reversed in order to disassemble a tubular string.

Although the top drive is a good alternative to the Kelly and rotary table, the possibility of inadvertently dropping a casing string into the wellbore exists. As noted above, a top drive and spider must work in tandem, that is, at least one of them must engage the casing string at any given time during casing assembly. Typically, an operator located on the platform controls the top drive and the spider with manually operated levers that control fluid power to the slips that cause the top drive and spider to retain a casing string. At any given time, an operator can inadvertently drop the casing string by moving the wrong lever. Conventional interlocking systems have been developed and used with elevator/spider systems to address this problem, but there remains a need for a workable interlock system usable with a top drive/spider system such as the one described herein.

There is a need therefore, for an interlock system for use with a top drive and spider to prevent inadvertent release of a tubular string. There is a further need for an interlock system to prevent the inadvertent dropping of a tubular or tubular string into a wellbore. There is also a need for an interlock system that prevents a spider or a top drive from disengaging a tubular string until the other component has engaged the tubular.

SUMMARY OF THE INVENTION

The present invention generally provides an apparatus and methods to prevent inadvertent release of a tubular or tubular string. In one aspect, the apparatus and methods disclosed herein ensure that either the top drive or the spider is engaged to the tubular before the other component is disengaged from the tubular. The interlock system is utilized with a spider and a top drive during assembly of a tubular string.

In another aspect, the present invention provides an apparatus for use with tubulars. The apparatus includes a first device for gripping and joining the tubulars, a second device for gripping the tubulars, and an interlock system to ensure that the tubulars are gripped by at least one of the first or second device.

In another aspect still, the present invention provides a method for assembling and dissembling tubulars. The method includes joining a first tubular engaged by a first apparatus to a second tubular engaged by a second apparatus thereby forming a tubular string. An interlock system is provided to ensure that at least one of the first apparatus or the second apparatus is engaging the tubular string. After the tubulars are joined, the second apparatus is opened to disengage the string, thereby allowing the tubular string to be lowered through the second apparatus. After the string is repositioned, the second apparatus is actuated to re-engage the tubular string. After the second apparatus secures the tubular string, the first apparatus is disengaged from the string.

In another aspect still, the first apparatus includes a gripping member for engaging the tubular. In one aspect, the gripping member is movably coupled to the first apparatus. Particularly, the gripping member may pivot relative to the first apparatus to facilitate engagement with the tubular. In one embodiment, a swivel is used to couple the gripping member to the first apparatus.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore, not to be considered limiting of its scope, for the invention may admit to other equally effective embodiments.

DETAILED DESCRIPTION OF THE PREFERRED EMBODIMENT

The present invention is an interlock system for use with a top drive and a spider during assembly of a string of tubulars. The invention may be utilized to assemble tubulars for different purposes including drill strings, strings of liner and casing and run-in strings for wellbore components.

Figure 1:
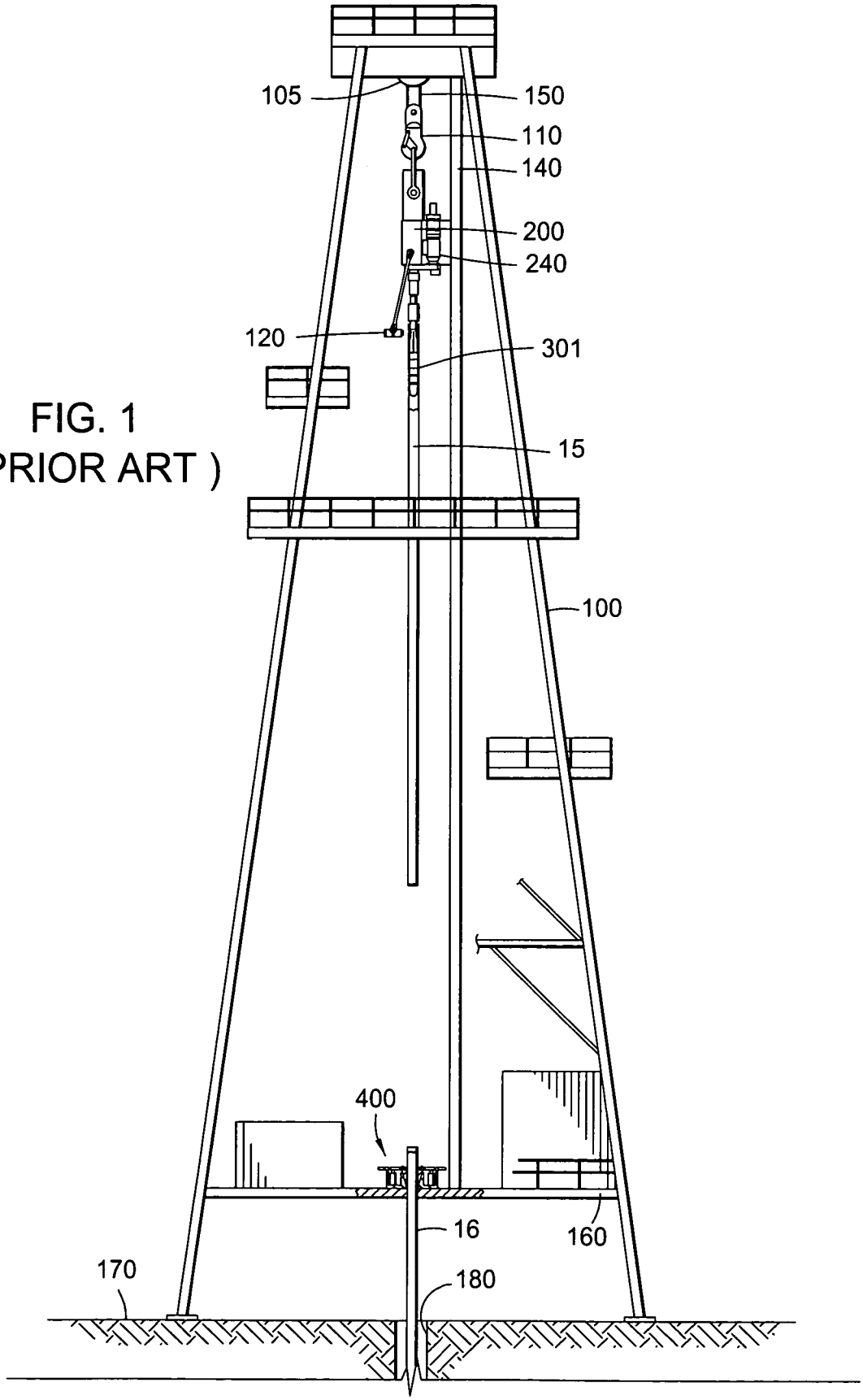
FIG. 1 ( PRIOR ART )
FIG. 1 shows a rig having a top drive and an elevator configured to connect tubulars.
Figure 2:
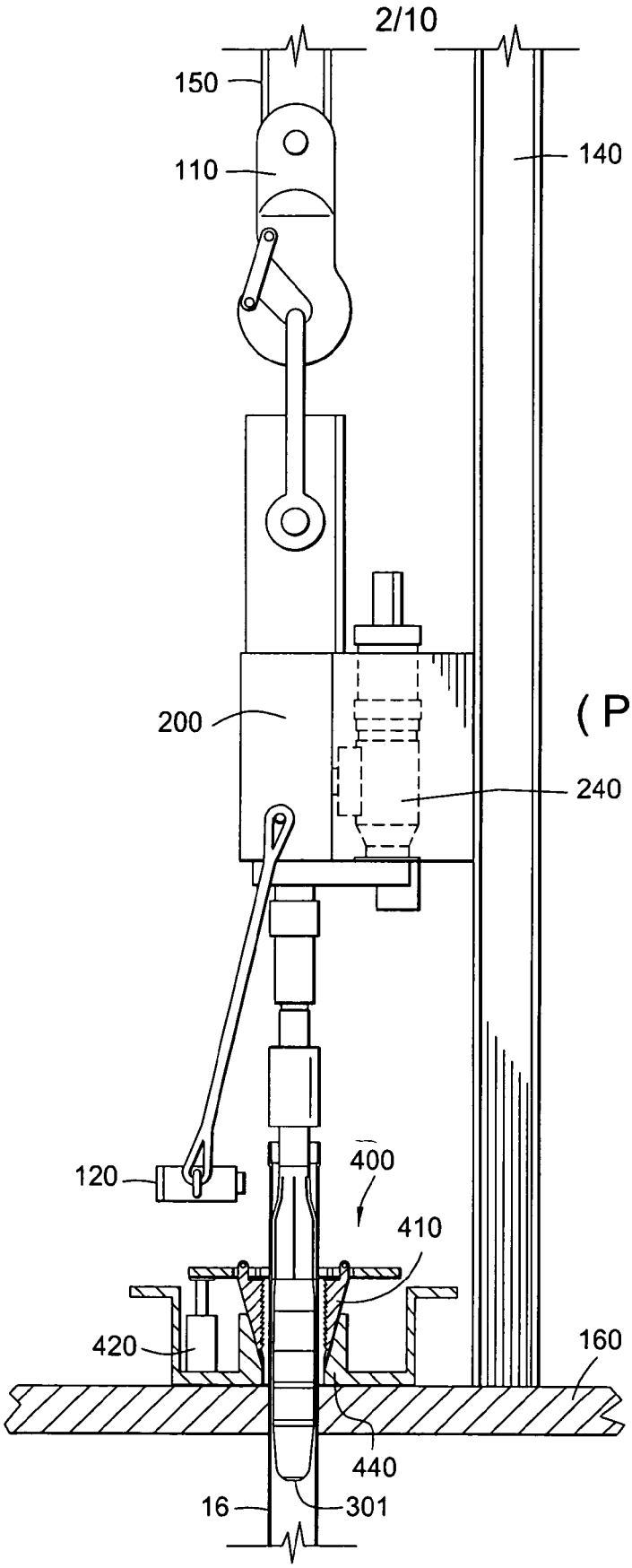
FIG. 2 ( PRIOR ART )
FIG. 2 illustrates the top drive engaged to a tubular that has been lowered through a spider.
Figure 3:
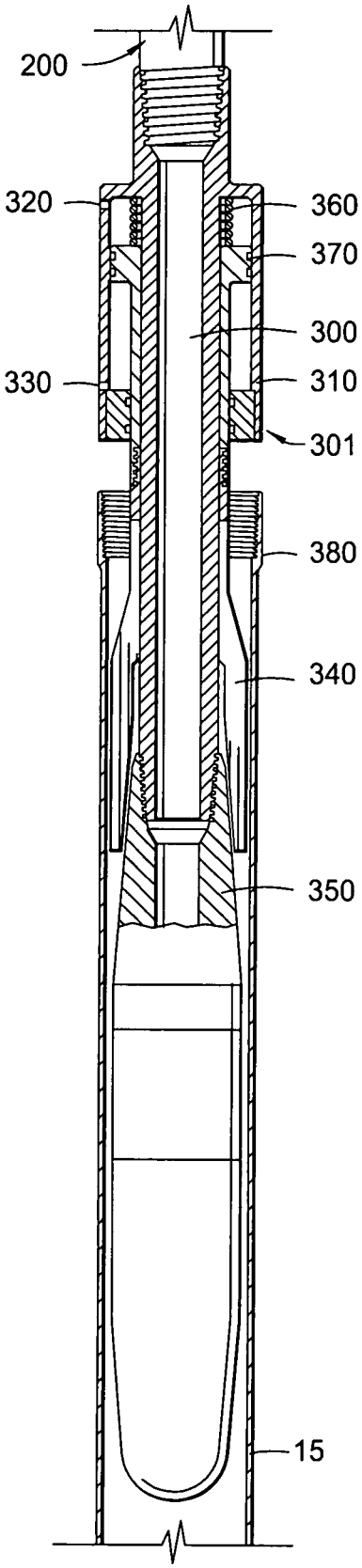
FIG. 3 is a cross-sectional view of a gripping member for use with a top drive for handling tubulars in the un-engaged position.
Figure 4:
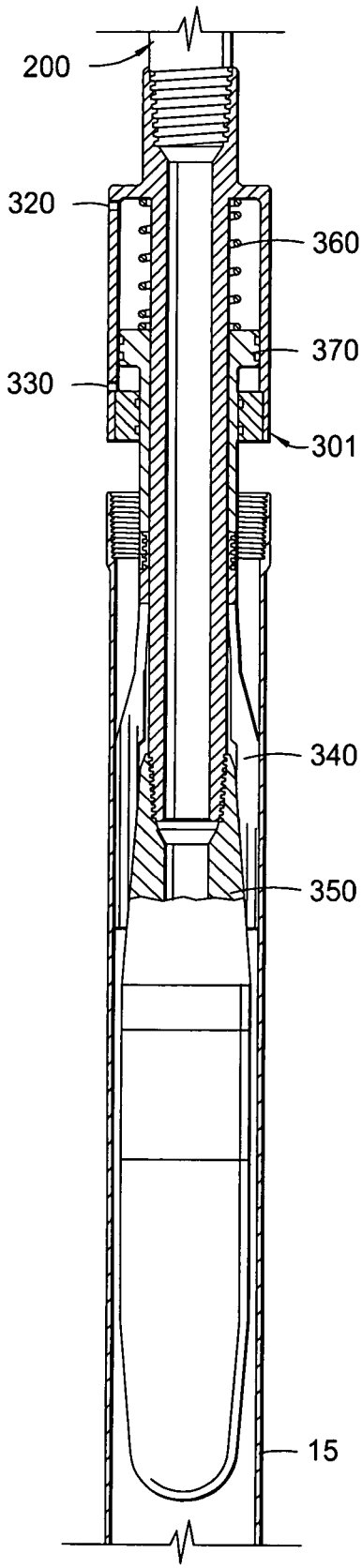
FIG. 4 is a cross-sectional view of the gripping member of FIG. 3 in the engaged position.
Figure 5:
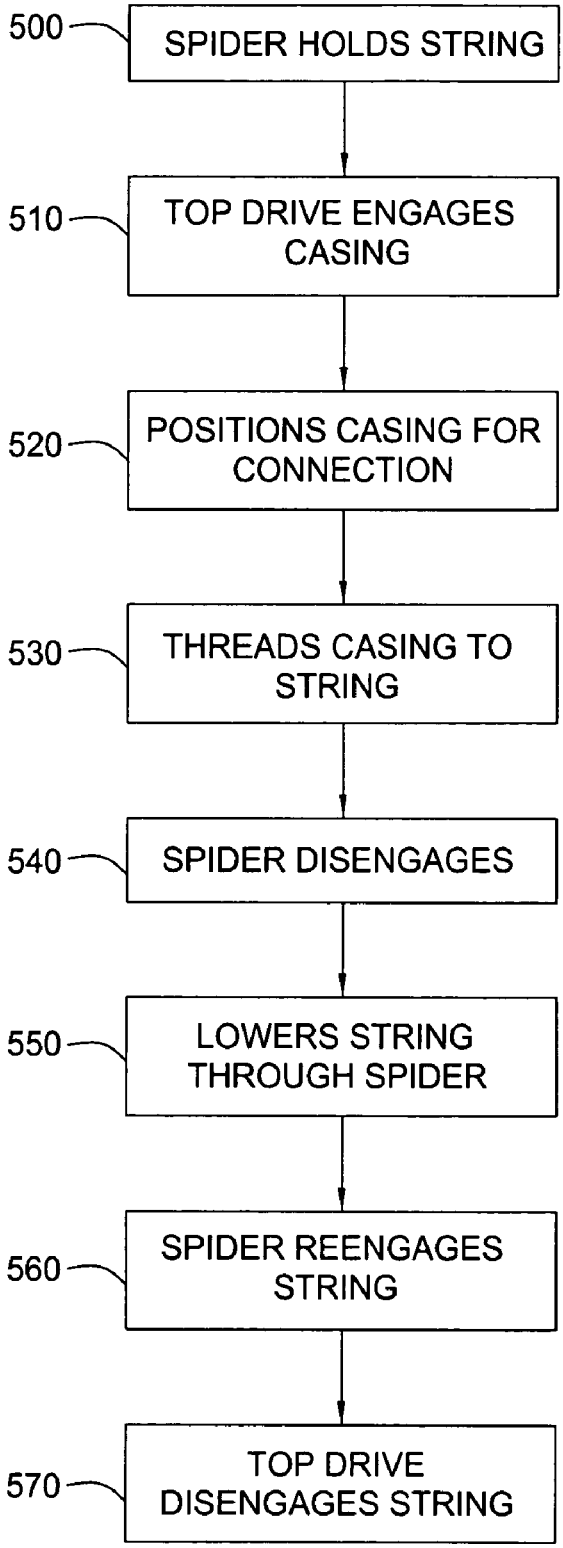
FIG. 5 is a flow chart for connecting tubulars using a top drive and a spider.
Figure 6:
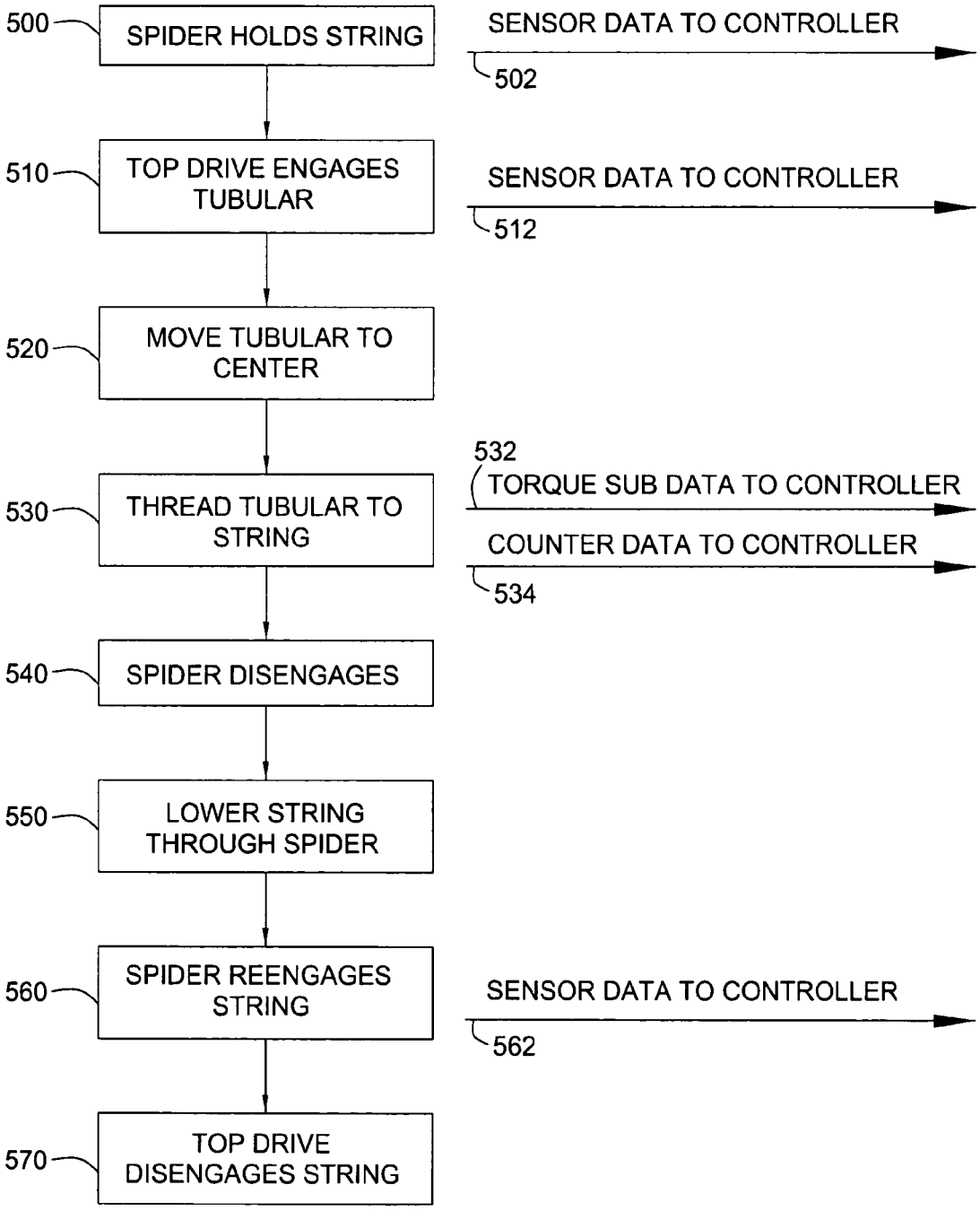
FIG. 6 shows a flow chart for connecting tubulars using an interlock system for a spider and a top drive according to aspects of the present invention.
Figure 8:
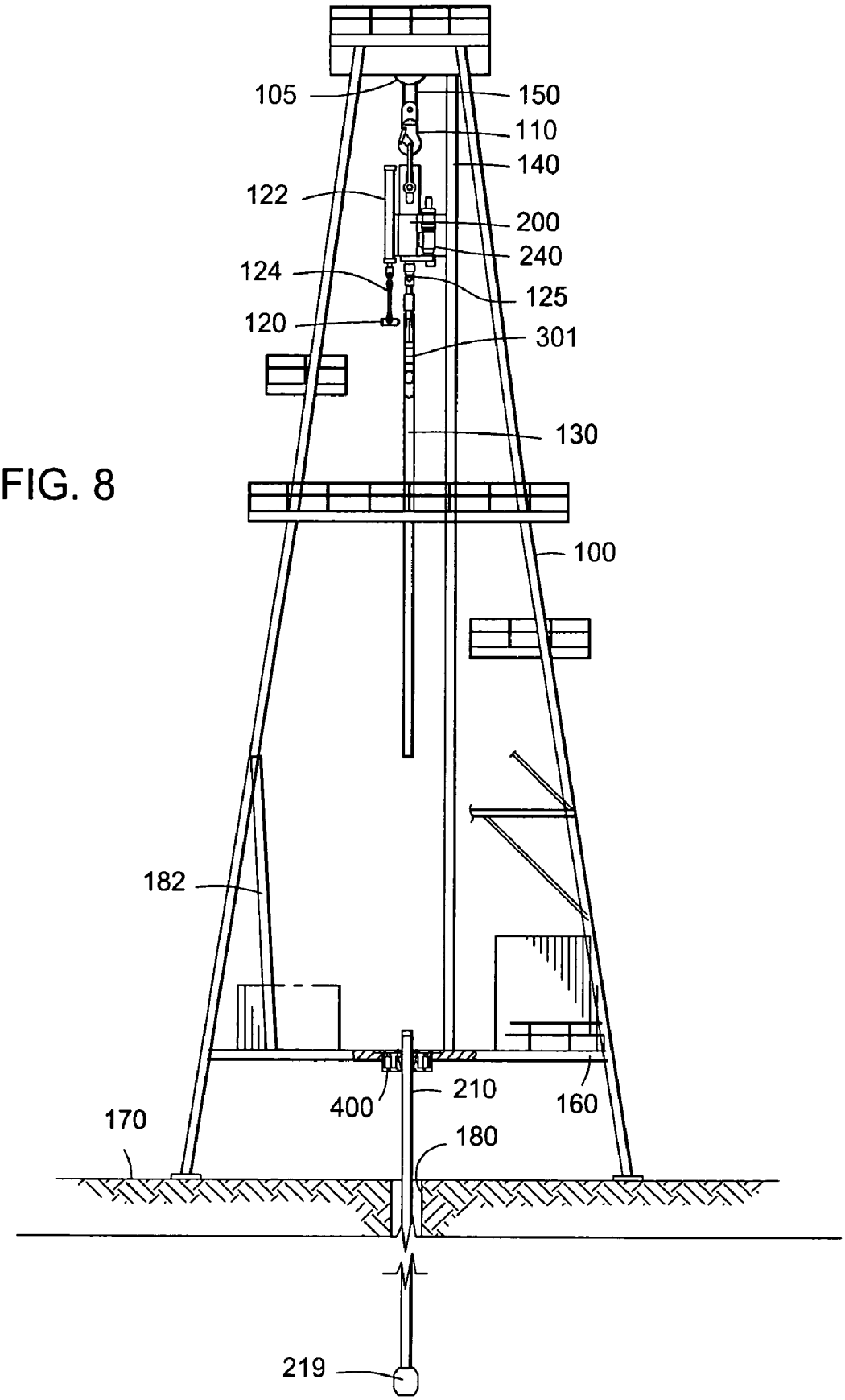
FIG. 8 illustrates the top drive of FIG. 7 after it has engaged the tubular.
Figure 10:
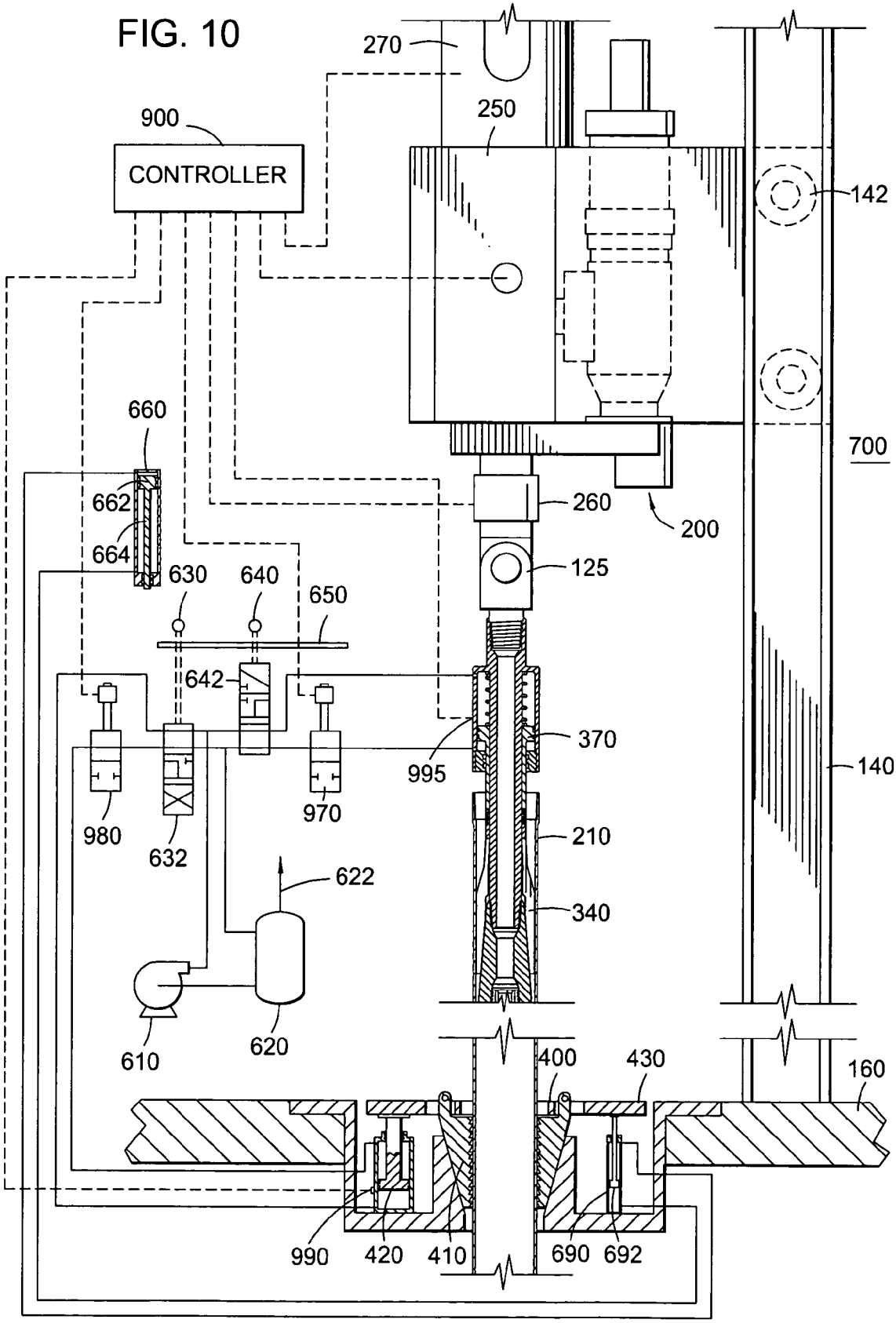
FIG. 10 illustrates the mechanics of the interlock system in use with a spider, a top drive and a controller according to aspects of the present invention.

FIG. 6 is a flow chart illustrating the use of an interlock system 700 of the present invention with a spider 400 and a top drive 200, and FIG. 10 illustrates the mechanics of the interlock system 700 in use with a spider 400, a top drive 200, and a controller 900. At step 500, a casing string 210 is retained in a closed spider 400 and prevented from moving in an axial direction, as illustrated in FIG. 8. In one embodiment, the spider 400 is a flush mounted spider that is disposed in the platform 160. Referring to FIG. 10, the spider 400 includes a spider piston sensor 990 located at a spider piston 420 to sense when the spider 400 is open or closed around the casing string 210. The sensor data 502 is relayed to a controller 900.

A controller 900 includes a programmable central processing unit that is operable with a memory, a mass storage device, an input control unit, and a display unit. Additionally, the controller 900 includes well-known support circuits such as power supplies, clocks, cache, input/output circuits and the like. The controller 900 is capable of receiving data from sensors and other devices and capable of controlling devices connected to it.

One of the functions of the controller 900 is to prevent opening of the spider 400. Preferably, the spider 400 is locked in the closed position by a solenoid valve 980 that is placed in the control line between the manually operated spider control lever 630 and the source of fluid power operating the spider 400. Specifically, the spider solenoid valve 980 controls the flow of fluid to the spider piston 420. The solenoid valve 980 is operated by the controller 900, and the controller 900 is programmed to keep the valve 980 closed until certain conditions are met. While valve 980 is electrically powered in the embodiment described herein, the valve 980 could be fluidly or pneumatically powered so long as it is controllable by the controller 900. Typically, the valve 980 is closed and the spider 400 is locked until a tubular 130 is successfully joined to the string 210 and held by the top drive 200.

At step 510, the top drive 200 is moved to engage a casing 130. Referring back to FIG. 7, the elevator 120 is coupled to the top drive 200 using a piston and cylinder assembly 122 and a pair of bails 124. The piston and cylinder assembly 122 may serve to axially translate the elevator 120 relative to the gripping means 301 of the top drive 200. As shown, the gripping means 301, also known as a gripping head, is an internal gripping apparatus, wherein it may be inserted into the casing 130 to engage an interior surface thereof. In one embodiment, a pivotable mechanism 125 is employed to facilitate the engagement of the gripping means 301 to the casing 130. An example of a suitable pivotable mechanism 125 includes a swivel 125 having a first portion 125A pivotable relative to a second portion 125B. The swivel 125 couples the gripping means 301 to the top drive 200 and allows the gripping means 301 to move or pivot relative thereto. Particularly, first and second portions 125A, 125B include connections means for connecting to the top drive 200 and the gripping means 301, respectively. Preferably, the pivotable mechanism 125 includes a bore therethrough for fluid communication between the top drive 200 and the gripping means 301.

Figure 7:
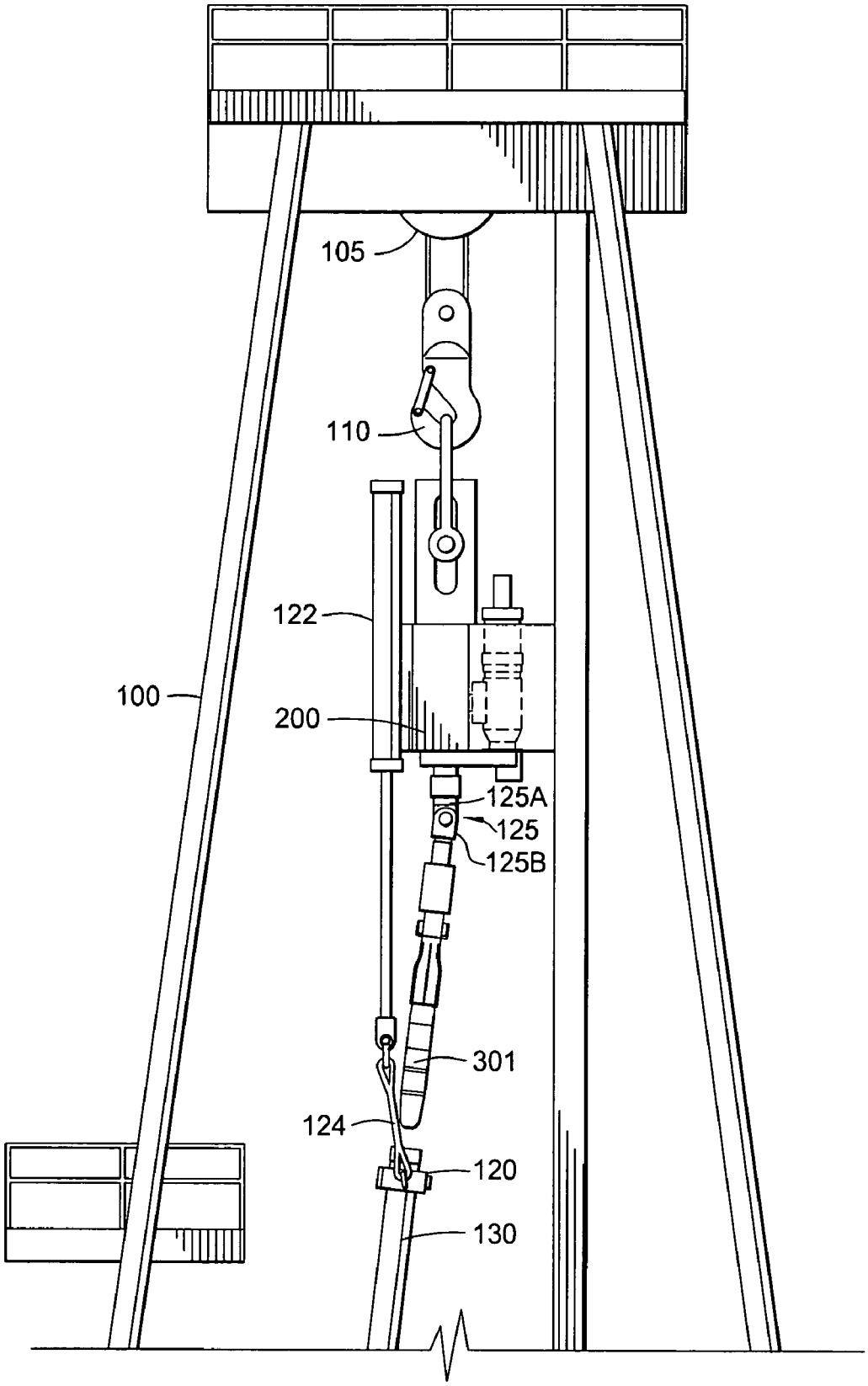
FIG. 7 illustrates an apparatus for connecting tubulars according to aspects of the present invention. The top drive is shown before it has engaged the tubular.

To engage the casing 130, the piston and cylinder assembly 122 is actuated to position the elevator 120 proximate the casing 130. The elevator 120 is then disposed around the casing 130. The movable bails 124 allow the casing 130 to tilt toward the well center. Thereafter, the gripping means 301 may be pivoted into alignment with the casing 130 for insertion thereof. Particularly, the swivel 125 is actuated to pivot the gripping means 301 as illustrated in FIG. 7. Once aligned, the gripping means 301 is inserted into the casing 130, and the slips 340 are actuated to engage the interior of the casing 130.

In one aspect, a top drive sensor 995 (FIG. 10) is placed near a top drive piston 370 to determine whether the gripping means 301 is engaged with the casing 130. The sensor data 512 is relayed to the controller 900 for processing.

At step 520, the top drive 200 moves the casing 130 into position above the casing string 210. Particularly, the swivel 125 is actuated to pivot the gripping means 301 toward the well center. In turn, the casing 130 is also positioned proximate the well center, and preferably, into alignment with the casing string 210 in the spider 400. Additionally, the traveling block 110 is actuated to lift the top drive 200 and the attached casing 130. In this manner, the casing 130 is aligned with the casing string 210 in the spider 400, as illustrated in FIG. 8.

At step 530, the top drive 200 rotationally engages the casing 130 to the casing string 210, thereby creating a threaded joint therebetween. In one embodiment, the top drive 200 may include a counter 250. The counter 250 is constructed and arranged to measure the rotation of the casing 130 during the make up process. The top drive 200 may also be equipped with a torque sub 260 to measure the amount of torque placed on the threaded connection. Torque data 532 from the torque sub 260 and rotation data 534 from the counter 250 are sent to the controller 900 for processing. The controller 900 is preprogrammed with acceptable values for rotation and torque for a particular connection. The controller 900 compares the rotation data 534 and the torque data 532 from the actual connections and determines if they are within the accepted values. If not, then the spider 400 remains locked and closed, and the casing 130 can be re-threaded or some other remedial action can take place by sending a signal to an operator. If the values are acceptable, the controller 900 locks the top drive 200 in the engaged position via a top drive solenoid valve 970 (FIG. 10) that prevents manual control of the top drive 200.

Figure 9:
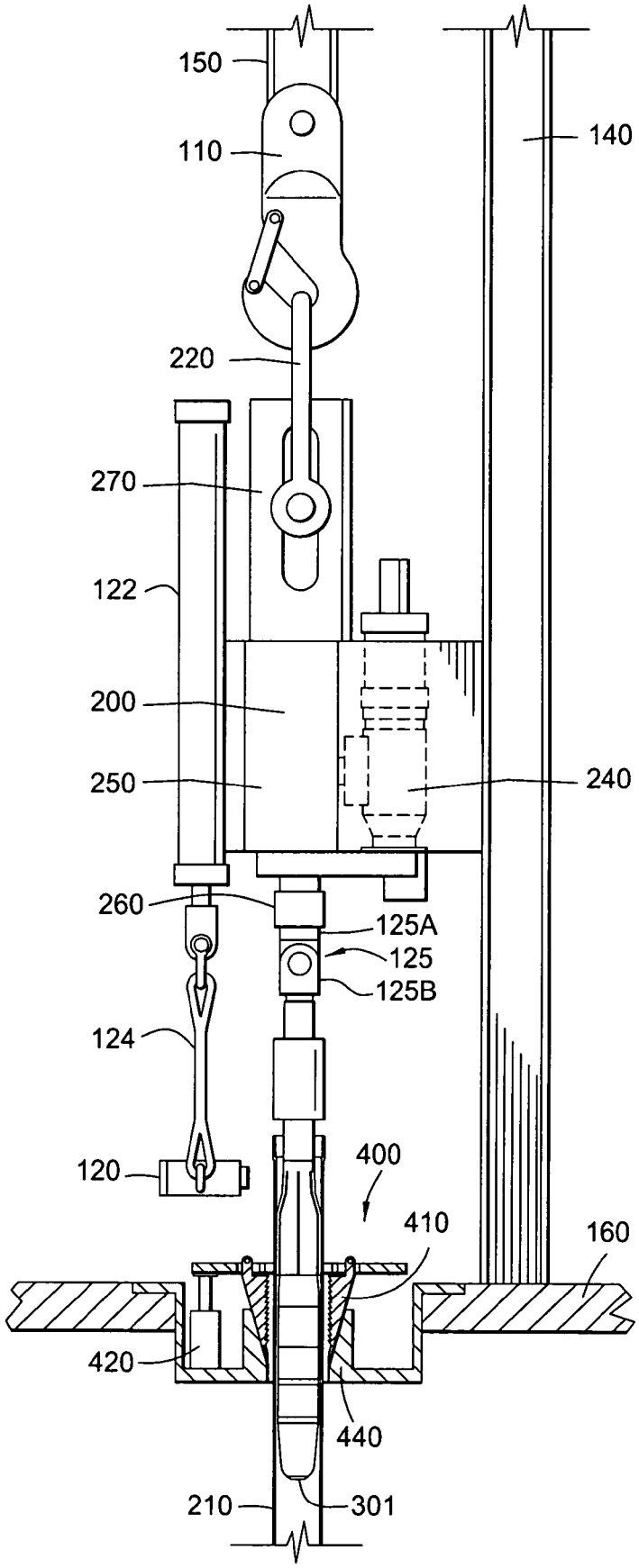
FIG. 9 illustrates the top drive of FIG. 7 after it has lowered the tubular toward the rig floor.

At step 540, the controller 900 unlocks the spider 400 via the spider solenoid valve 980, and allows fluid to power the piston 420 to open the spider 400 and disengage it from the casing string 210. At step 550, the top drive 200 lowers the casing string 210, including casing 130, through the opened spider 400. FIG. 9 shows the casing 130 lowered by the top drive 200.

At step 560, the spider 400 is closed around the casing string 210. At step 562, the spider sensor 990 (FIG. 10) signals to the controller 900 that the spider 400 is closed. If a signal is received confirming that the spider 400 is closed, the controller 900 locks the spider 400 in the closed position, and unlocks the top drive 200. If no signal is received, the top drive 200 stays locked and engaged to casing string 210. At step 570, after a signal is received, the top drive 200 disengages the casing string 210 and may proceed to add another casing 130. In this manner, at least the top drive 200 or the spider 400 is engaging the casing string 210 at all times.

Alternatively, or in addition to the foregoing, a compensator 270 may be utilized to gather additional information about the joint formed between the tubular and the tubular string. In one aspect, the compensator 270 couples the top drive 200 to the traveling block 110. The compensator 270 may function similar to a spring to compensate for vertical movement of the top drive 200 during threading of the casing 130 to the casing string 210. The compensator 270, in addition to allowing incremental movement of the top drive 200 during threading together of the tubulars, may be used to ensure that a threaded joint has been made and that the tubulars are mechanically connected together. For example, after a joint has been made between the tubular and the tubular string, the top drive may be raised or pulled up. If a joint has been formed between the tubular and the string, the compensator will "stoke out" completely, due the weight of the tubular string therebelow. If however, a joint has not been formed between the tubular and the string due to some malfunction of the top drive or misalignment between a tubular and a tubular string therebelow, the compensator will stroke out only a partial amount due to the relatively little weight applied thereto by the single tubular or tubular stack. A stretch sensor located adjacent the compensator, can sense the stretching of the compensator 270 and can relay the data to a controller 900. Once the controller 900 processes the data and confirms that the top drive is engaged to a complete tubular string, the top drive 200 is locked in the engaged position, and the next step 540 can proceed. If no signal is received, then the spider 400 remains locked and a signal maybe transmitted by the controller to an operator. During this "stretching" step, the spider 400 is not required to be unlocked and opened. The spider 400 and the slips 410 are constructed and arranged to prevent downward movement of the string but allow the casing string 210 to be lifted up and moved axially in a vertical direction even though the spider is closed. When closed, the spider 400 will not allow the casing string 210 to fall through its slips 410 due to friction and the shaped of the teeth on the spider slips.

The interlock system 700 is illustrated in FIG. 10 with the spider 400, the top drive 200, and the controller 900 including various control, signal, hydraulic, and sensor lines. The top drive 200 is shown engaged to a casing string 210 and is coupled to a railing system 140. The railing system 140 includes wheels 142 allowing the top drive 200 to move axially. The spider 400 is shown disposed in the platform 160 and in the closed position around the casing string 210. The spider 400 and the top drive 200 may be pneumatically actuated, however the spider 400 and top drive 200 discussed herein are hydraulically activated. Hydraulic fluid is supplied to a spider piston 420 via a spider control valve 632. The spider control valve 632 is a three-way valve and is operated by a spider lever 630.

Also shown in FIG. 10 is a sensor assembly 690 with a piston 692 coupled to spider slips 410 to detect when the spider 400 is open or closed. The sensor assembly 690 is in communication with a locking assembly 660, which along with a control plate 650 prevents the movement of the spider 400 and top drive lever. The locking assembly 660 includes a piston 662 having a rod 664 at a first end. The rod 564 when extended, blocks the movement of the control plate 550 when the plate is in a first position. When the spider 400 is in the open position, the sensor assembly 690 communicates to the locking assembly 660 to move the rod 664 to block the control plate's 650 movement. When the spider 400 is in the closed position as shown, the rod 664 is retracted allowing the control plate 650 to move freely from the first to a second position. Additionally, the sensor assembly 660 can also be used with the top drive 200 as well in the same fashion. Similarly, hydraulic fluid is supplied to a top drive piston 370 via a top drive control valve 642 and hydraulic lines. The top drive control valve 642 is also a three-way valve and is operated by a top drive lever 640. A pump 610 is used to circulate fluid to the respective pistons 370, 420. A reservoir 620 is used to re-circulate hydraulic fluid and receive excess fluid. Excess gas in the reservoir 620 is vented 622.

Further shown in FIG. 10, controller 900 collects data from a top drive sensor 995 regarding the engagement of the top drive to the casing string 210. Data regarding the position of the spider 400 is also provided to the controller 900 from a spider sensor 990. The controller 900 controls fluid power to the top drive 200 and spider 400 via solenoid valves 970, 980, respectively.

In FIG. 10, the top drive 200 is engaged to casing string 210 while the spider 400 is in the closed position around the same casing string 210. At this point, steps 500, 510, 520, and 530 of FIG. 6 have occurred. Additionally, the controller 900 has determined through the data received from counter 250 and torque sub 260 that an acceptable threaded joint has been made between casing 130 and casing string 210. In the alternative or in addition to the foregoing, a compensator 270 can also provide data to the controller 900 that a threaded joint has been made and that the casing 130 and the casing string 210 are mechanically connected together via a stretch sensor (not shown). The controller 900 then sends a signal to a solenoid valve 970 to lock and keep a top drive piston 370 in the engaged position within the casing string 210. Moving to step 540 (FIG. 6), the controller 900 can unlock the previously locked spider 400, by sending a signal to a solenoid valve 980. The spider 400 must be unlocked and opened in order for the top drive 200 to lower the casing string 210 through the spider 400 and into a wellbore. An operator (not shown) can actuate a spider lever 630 that controls a spider valve 632, to allow the spider 400 to open and disengage the casing string 210. When the spider lever 630 is actuated, the spider valve 632 allows fluid to be flow to spider piston 420 causing spider slips 410 to open. With the spider 400 opened, a sensor assembly 690 in communication with a locking assembly 660 will cause a rod 664 to block the movement of a control plate 650. Because the plate 650 will be blocked in the rightmost position, the top drive lever 640 is held in the locked position and will be unable to move to the open position.

As illustrated in FIG. 10, the interlock system 700 when used with the top drive 200 and the spider 400 prevents the operator from inadvertently dropping the casing string 210 into the wellbore. As disclosed herein, the casing string 210 at all times is either engaged by the top drive 200 or the spider 400. Additionally, the controller 900 may prevent operation of the top drive 200 under certain situations, even if the top drive control lever 640 is actuated.

Figure 11:
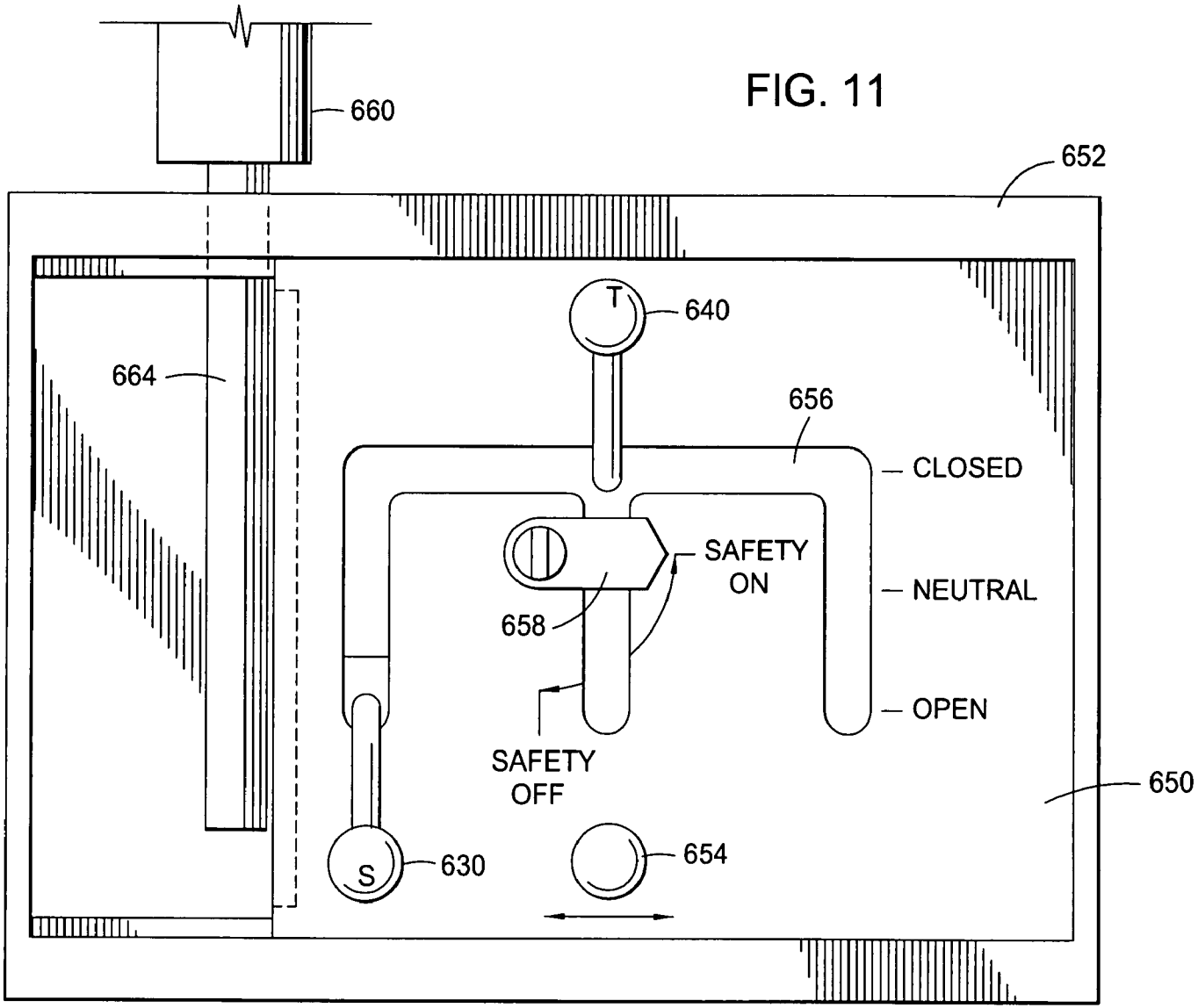
FIG. 11 illustrates a control plate for a spider lever and a top drive lever according to aspects of the present invention.

In another aspect, the interlock system 700 may include a control plate 650 to control the physical movement of levers 630, 640 between the open and closed positions, thereby preventing the operator from inadvertently actuating the wrong lever. FIG. 11 illustrates a control plate 650 for a spider lever 630 and a top drive lever 640 that can be used with the interlock system 700 of the present invention. The control plate 650 is generally rectangular in shape and is provided with a series of slots 656 to control the movement of the spider lever 630, and the top drive lever 640. Typically, the control plate 650 is slideably mounted within a box 652. The slots 656 define the various positions in which the levers 630, 640 may be moved at various stages of the tubular assembly or disassembly. The levers 630, 640 can be moved in three positions: (1) a neutral position located in the center; (2) a closed position located at the top and causes the slips to close; and (3) an open position located at the bottom, which causes the slips to open. The control plate 650 can be moved from a first rightmost position to a second leftmost position with a knob 654. However, both levers 630, 640 must be in the closed position before the control plate is moved from one position to another. The control plate 650 is shown in the first rightmost position with a rod 664 extending from a locking assembly 660 to block the movement of the control plate. In operation, in the first rightmost position of the control plate 650, the spider lever 630 can be moved between the open and close positions, while the top drive lever 640 is kept in the closed position. In the second leftmost position, the top drive lever 640 can be moved between the open and close positions, while the spider lever 630 is kept in the closed position. A safety lock 658 is provided to allow the top drive or spider levers 630, 640 to open and override the control plate 650 when needed.

The interlock system 700 may be any interlock system that allows a set of slips to disengage only when another set of slips is engaged to the tubular. The interlock system 700 may be mechanically, electrically, hydraulically, pneumatically actuated systems. The spider 400 may be any spider that functions to hold a tubular or a tubular string at the surface of the wellbore. A top drive 200 may be any system that includes a gripping means for retaining a tubular by the inner or outer surface and can rotate the retained tubular. The gripping means may include an internal gripping apparatus such as a spear, an external gripping apparatus such as a torque head, or any other gripping apparatus for gripping a tubular as known to a person of ordinary skill in the art. For example, the external gripping apparatus may include a sensor for detecting information from its slips to ensure proper engagement of the casing. The top drive 200 can also be hydraulically or pneumatically activated.

While the foregoing is directed to the preferred embodiment of the present invention, other and further embodiments of the invention may be devised without departing from the basic scope thereof, and the scope thereof is determined by the claims that follow.

I claim:

1. A method of connecting casing sections by using a top drive, comprising:

closing a first member around a first casing section;

gripping and supporting a weight of a second casing section with the top drive;

rotating the second casing section with the top drive to join the second casing section to the first casing section to form a joint and a casing string;

sending data from the top drive to a controller, wherein the controller is preprogrammed with an acceptable torque value of the joint;

stopping rotation of the second casing section based on the acceptable torque value of the joint;

supporting a weight of the casing string with the top drive; and opening the first member.

2. The method of claim 1, further comprising:

lowering the casing string through the first member.

3. The method of claim 2, further comprising:

closing the first member around the casing string.

4. The method of claim 3, further comprising:

disengaging the top drive from the casing string.

5. The method of claim 1, wherein the controller is further preprogrammed with an acceptable rotation value.

6. The method of claim 1, wherein the acceptable torque value is a value limit.

7. The method of claim 1, wherein the first member comprises a spider.

8. The method of claim 1, wherein sending comprises transmitting.

9. The method of claim 1, wherein the data is indicative of a torque value of the joint.

10. The method of claim 1, wherein the top drive comprises at least one adapter for gripping a casing.

11. The method of claim 10, wherein the adapter comprises an elevator.

12. The method of claim 10, wherein the adapter comprises a spear.

13. The method of claim 10, wherein the adapter comprises a torque head.

14. The method of claim 10, wherein the adapter comprises movable slips.

15. The method of claim 10, wherein the adapter comprises an elevator and a gripping member having movable slips.

16. The method of claim 1, wherein the top drive comprises a torque sub.

17. The method of claim 1, wherein the top drive comprises a rotation counter.

18. The method of claim 1, wherein the gripping and supporting comprises gripping and supporting with movable slips.

19. The method of claim 1, wherein the controller includes a data storage device.

20. The method of claim 1, wherein the controller is configured to control at least one device connected to it.

21. The method of claim 1, wherein the controller includes a display unit.

22. The method of claim 1, wherein the controller includes a clock, a cache, an input control unit and an input/output circuit.

23. The method of claim 1, further comprising comparing at least a portion of the data with the acceptable torque value using the controller.

24. The method of claim 23, further comprising initiating remedial action using the controller.

25. The method of claim 24, wherein the initiating comprises sending a signal to an operator.

26. The method of claim 1, further comprising:

preprogramming the controller with an acceptable axial load value of the joint; and comparing at least a portion of the data with the acceptable axial value using the controller.

27. A system for connecting casing sections comprising:

a top drive comprising at least one adapter for gripping a casing section;

a processing unit for receiving data indicative of a torque value of a casing connection between the casing section and a casing string; and an user interface for conveying the value of the casing connection to an operator.

28. The system of claim 27, wherein the processing unit is programmable.

29. The system of claim 27, wherein the processing unit comprises a data storage device.

30. The system of claim 27, wherein the processing unit comprises a memory.

31. The system of claim 27 wherein the user interface comprises a display unit.

32. The system of claim 27, wherein the processing unit contains at least one acceptable torque value of the casing connection.

33. The system of claim 32, wherein the processing unit further comprises a comparator for comparing the data with the at least one acceptable torque value.

34. The system of claim 27, wherein the processing unit is further adapted to receive data indicative of a rotation value.

35. The system of claim 27, wherein the adapter comprises movable slips.

36. The system of claim 27, wherein the adapter comprises an elevator.

37. The system of claim 36, wherein the elevator is suspended by at least one movable bail.

38. The system of claim 27, further comprising a torque sub for measuring the torque value.

39. The system of claim 38, further comprising a rotation counter for measuring a rotation value.

40. The system of claim 39, further comprising a compensator for compensating movement of the casing section during connection.

41. The system of claim 40, further comprising a sensor for measuring an axial load on the compensator.

42. The system of claim 27, further comprising a rotation counter for measuring a rotation value.

43. The system of claim 42, further comprising a compensator for compensating movement of the casing section during connection.

44. The system of claim 43, further comprising a sensor for measuring an axial load of the casing connection.

45. The system of claim 27, wherein the processing unit is further adapted to receive an axial load value of the casing connection.

46. The system of claim 27, further comprising a spider for retaining the casing string.

47. The system of claim 27, wherein the adapter comprises a gripping member having movable slips.

48. The system of claim 47, further comprising an elevator.

49. The system of claim 48, further comprising a torque sub operatively coupled to the gripping member.

50. The system of claim 49, wherein the torque sub is adapted to collect data relating to the casing connection.

51. The system of claim 50, wherein the gripping member engages an interior surface of the casing section.

52. The system of claim 50, wherein the gripping member engages an exterior surface of the casing section.

53. The system of claim 50, wherein the processing unit is further adapted to receive data indicative of a rotation value.

54. A method of connecting casing sections, comprising:

closing a spider around a first casing;

engaging a second casing with a top drive having a casing gripping apparatus connected thereto;

moving the second casing to a well center;

threading the second casing to the first casing to form a joint and a casing string;

sending data from the top drive to a processing unit, wherein the processing unit is preprogrammed with at least one acceptable torque value of the joint;

opening the spider;

lowering the casing string through the spider;

closing the spider around the casing string; and disengaging the top drive from the casing string.

55. The method of claim 54, wherein the top drive further comprises an elevator operatively coupled thereto.

56. The method of claim 55, wherein moving the second casing comprises:

moving with the second casing using the elevator.

57. The method of claim 54, further comprising raising the top drive and thereby raising the casing string.

58. The method of claim 54, further comprising ensuring that a threaded connection has been made.

59. A method of connecting casing sections, comprising:

closing a first member around a first casing;

engaging a second casing with a second member;

moving the second casing to a well center;

threading the second casing to the first casing to form a joint and a casing string;

sending data from the second member to a controller, wherein the controller is preprogrammed with an acceptable torque value of the joint;

opening the first member;

lowering the casing string through the first member;

closing the first member around the casing string; and disengaging the second member from the casing string.

60. The method of claim 59, wherein the controller is further preprogrammed with an acceptable rotation value.

61. The method of claim 60, wherein the acceptable torque and rotation values are value limits.

62. The method of claim 59, wherein the first member comprises a spider.

63. The method of claim 59, wherein sending comprises transmitting.

64. The method of claim 59, wherein the data is indicative of at least one value of the joint.

65. The method of claim 64, wherein the at least one value is torque.

66. The method of claim 59, wherein the second member comprises a top drive comprising at least one adapter for gripping a casing.

67. The method of claim 66, wherein the top drive comprises a torque sub.

68. The method of claim 66, wherein the adapter comprises an elevator.

69. The method of claim 66, wherein the adapter comprises a spear.

70. The method of claim 66, wherein the adapter comprises a torque head.

71. The method of claim 66, wherein the adapter comprises movable slips.

72. The method of claim 66, wherein the adapter comprises an elevator and a gripping member having movable slips.

73. The method of claim 66, wherein the top drive comprises a rotation counter.

74. The method of claim 59, wherein engaging comprises gripping with movable slips.

75. The method of claim 59, wherein the controller includes a data storage device.

76. The method of claim 59, wherein the controller is configured to control at least one device connected to it.

77. The method of claim 59, wherein the controller includes a display unit.

78. The method of claim 59, wherein the controller includes a clock, a cache, an input control unit and an input/output circuit.

79. The method of claim 59, further comprising comparing at least a portion of the data with the acceptable torque value using the controller.

80. The method of claim 79, further comprising initiating remedial action using the controller.

81. The method of claim 80, wherein the initiating comprises sending a signal to an operator.

* * * * *

US007281587C1

(12) INTER PARTES REEXAMINATION CERTIFICATE (641st)

United States Patent
Haugen

(10) Number: US 7,281,587 C1
(45) Certificate Issued: Jul. 18, 2013

(54) APPARATUS AND METHODS FOR TUBULAR MAKEUP INTERLOCK

(75) Inventor: David M. Haugen, League City, TX (US)

(73) Assignee: Weatherford/Lamb, Inc., Houston, TX (US)

Reexamination Request:
No. 95/001,116, Nov. 18, 2008

Reexamination Certificate for:

| | |
|---|---|
| Patent No.: | **7,281,587** |
| Issued: | **Oct. 16, 2007** |
| Appl. No.: | **11/393,311** |
| Filed: | **Mar. 30, 2006** |

Related U.S. Application Data

(63) Continuation of application No. 10/625,840, filed on Jul. 23, 2003, now Pat. No. 7,073,598, which is a continuation of application No. 09/860,127, filed on May 17, 2001, now Pat. No. 6,742,596.

(51) Int. Cl.
*E21B 19/16* (2006.01)

(52) U.S. Cl.
USPC ..... 166/380; 166/77.52; 166/77.53; 166/85.1

(58) Field of Classification Search
USPC ..... 166/380, 77.52, 77.53, 85.1
See application file for complete search history.

(56) References Cited

To view the complete listing of prior art documents cited during the proceeding for Reexamination Control Number 95/001,116, please refer to the USPTO's public Patent Application Information Retrieval (PAIR) system under the Display References tab.

*Primary Examiner* — Matthew C. Graham

(57) ABSTRACT

Apparatus and methods used to prevent an operator from inadvertently dropping a string into a wellbore during assembling and disassembling of tubulars. Additionally, the apparatus and methods may be used for running in wellbore components or for a drill string.

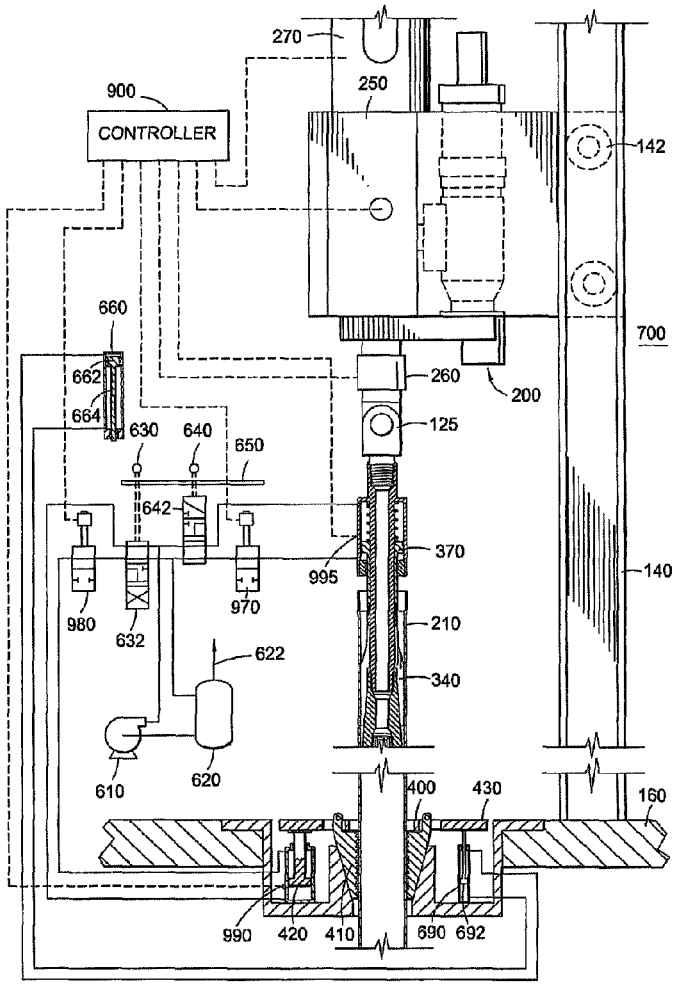

INTER PARTES REEXAMINATION CERTIFICATE ISSUED UNDER 35 U.S.C. 316

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 27-53, 59 and 66 are cancelled.

Claims 60, 62-64 and 74-79 are determined to be patentable as amended.

Claims 61, 65, 80 and 81, dependent on an amended claim, are determined to be patentable.

New claim 82 is added and determined to be patentable.

Claims 1-26, 54-58 and 67-73 were not reexamined.

60. The method of claim [59] *82*, wherein the controller is further preprogrammed with an acceptable rotation value.

62. The method of claim [59] *82*, wherein the first member comprises a spider.

63. The method of claim [59] *82*, wherein sending comprises transmitting.

64. The method of claim [59] *82*, wherein the data is indicative of at least one value of the joint.

74. The method of claim [59] *82*, wherein engaging comprises gripping with movable slips.

75. The method of claim [59] *82*, wherein the controller includes a data storage device.

76. The method of claim [59] *82*, wherein the controller is configured to control at least one device connected to it.

77. The method of claim [59] *82*, wherein the controller includes a display unit.

78. The method of claim [59] *82*, wherein the controller includes a clock, a cache, an input control unit and an input/output circuit.

79. The method of claim [59] *82*, further comprising comparing at least a portion of the data with the acceptable torque value using the controller.

*82. A method of connecting casing sections, comprising:*

*closing a first member around a first casing;*

*engaging a second casing with a second member, wherein the second member comprises a top drive comprising at least one adapter for gripping a casing;*

*moving the second casing to a well center;*

*threading the second casing to the first casing to form a joint and a casing string;*

*sending data from the second member to a controller, wherein the controller is preprogrammed with an acceptable torque value of the joint;*

*opening the first member;*

*lowering the casing string through the first member;*

*closing the first member around the casing string; and*

*disengaging the second member from the casing string.*

* * * * *